United States Patent [19]

Hou

[11] Patent Number: 5,018,056

[45] Date of Patent: May 21, 1991

[54] KITE FOR USE AT NIGHT HAVING A SHINING AND GLITTERING EFFECT

[76] Inventor: Chao-Kuo Hou, #8 Lane 67 Min Tzu St., Yung Ho City, Taipei County, Taiwan

[21] Appl. No.: 486,924

[22] Filed: Mar. 1, 1990

[51] Int. Cl.[5] ..... F21V 33/00

[52] U.S. Cl. ..... 362/253; 362/802

[58] Field of Search ..... 244/153 R, 155 R; 362/103, 802, 253

[56] References Cited

U.S. PATENT DOCUMENTS

| | | | |
|---|---|---|---|
| 2,465,917 | 3/1949 | Neary | 244/153 R |
| 2,488,118 | 11/1949 | Cobb et al. | 244/153 R |
| 3,304,651 | 2/1967 | Deyerl | 362/802 |
| 4,336,915 | 6/1982 | Stoecklin et al. | 244/153 R |
| 4,709,307 | 11/1987 | Branom | 362/103 |

*Primary Examiner*—Stephen F. Husar
*Assistant Examiner*—Sue Hagarman
*Attorney, Agent, or Firm*—Fleit, Jacobson, Cohn, Price, Holman & Stern

[57] ABSTRACT

A kite for use at night having a plurality of electrical (LED) lamps disposed on face of the kite. A control box is connected and proximate the kite at the end of a kite line. The control box includes a battery power supply, a mercury switching circuit and a harmonic oscillating circuit. The mercury switching circuit comprises a chamber containing a mercury ball movable between a plurality of switching positions. The electrical lamps are arranged in discrete groups of geometrical shapes and selectively energized by the mercury ball occupying a particular one of the switching positions in response to the lateral movement of the kite.

6 Claims, 4 Drawing Sheets

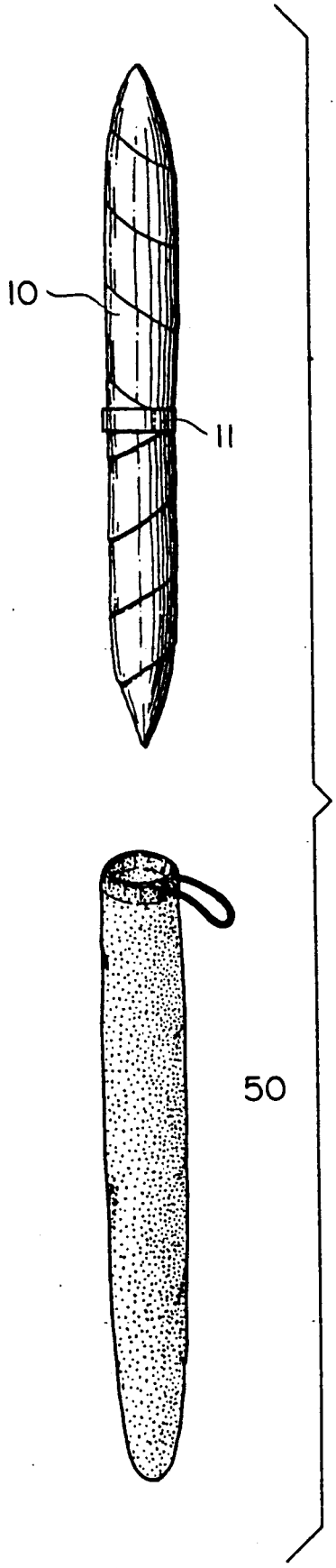
FIG. 6
FIG. 7
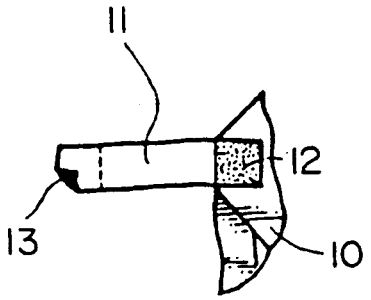

KITE FOR USE AT NIGHT HAVING A SHINING AND GLITTERING EFFECT

BACKGROUND OF THE INVENTION

The present invention relates to a kite and more specifically to a kite for use at night and having a shining and glittering effect dependent on the orientation of the kite.

Kites have been and remain one of the most interesting child's toys. Along with other technological advances the designs of kites have also changed and improved. However, most kites heretofore known can only be flown during the daytime and are not suitable to be flown at night because the user can not easily see and control the movement of the kite. Further, when flying a kite at night, one must be careful not to catch the kite on elevated objects. And if many kites are flown in the same vicinity at night, there is a risk that the kites would entangle with each other and eventually drop to the ground.

SUMMARY OF THE INVENTION

In view of the above it is a primary object of the present invention to provide a kite which can be flown at night.

It is an additional object of the present invention to provide a kite capable of being flown at night which exhibits an illuminated shining and glittering effect.

The kite according to the present invention comprises highly illuminating LED lamps divided into groups to constitute various shapes and patterns and connected via a lead to a control box containing a built-in battery chamber, mercury switch and a harmonic oscillating circuit. A hook and fastener for holding the rope to be held or pulled by the user are installed at the lower part of the control box to connect the control box to the kite line.

When the kite is not in use, the parts are dissembled for storage. The side edge of the kite includes a velcro fastener belt whereby the kite can be rolled up and secured in a storage state.

The mercury switch includes a ball and a plurality of contacts each associated with a particular group of LED lamps so that when the ball is in one particular switch position the harmonic oscillating circuit is connected to the associated group of LED lamps. The LED lamps are preferably arranged in the specially designed patterns, such as, the moon, stars, and in a heart shape.

It is another object of the present invention to provide a kite having shining and flashing effects so that the user of the kite can see the direction of movement of the kite for proper manipulation.

A further object of the present invention is to provide a kite with an adhesive velcro fastener belt so that after use, the kite is rolled and secured for storage.

The above and other objects and advantages of the present invention will become more readily apparent when reference is made to the following description taken in conjunction with the accompanying drawings.

BRIEF DESCRIPTION OF THE DRAWINGS

FIG. 6 is a view illustrating the kite according to the present invention in storage form.

FIG. 7 is a partial view illustrating the fastening belt for securing the kite in its storage form.

DETAILED DESCRIPTION OF THE DRAWINGS

Figure 1:
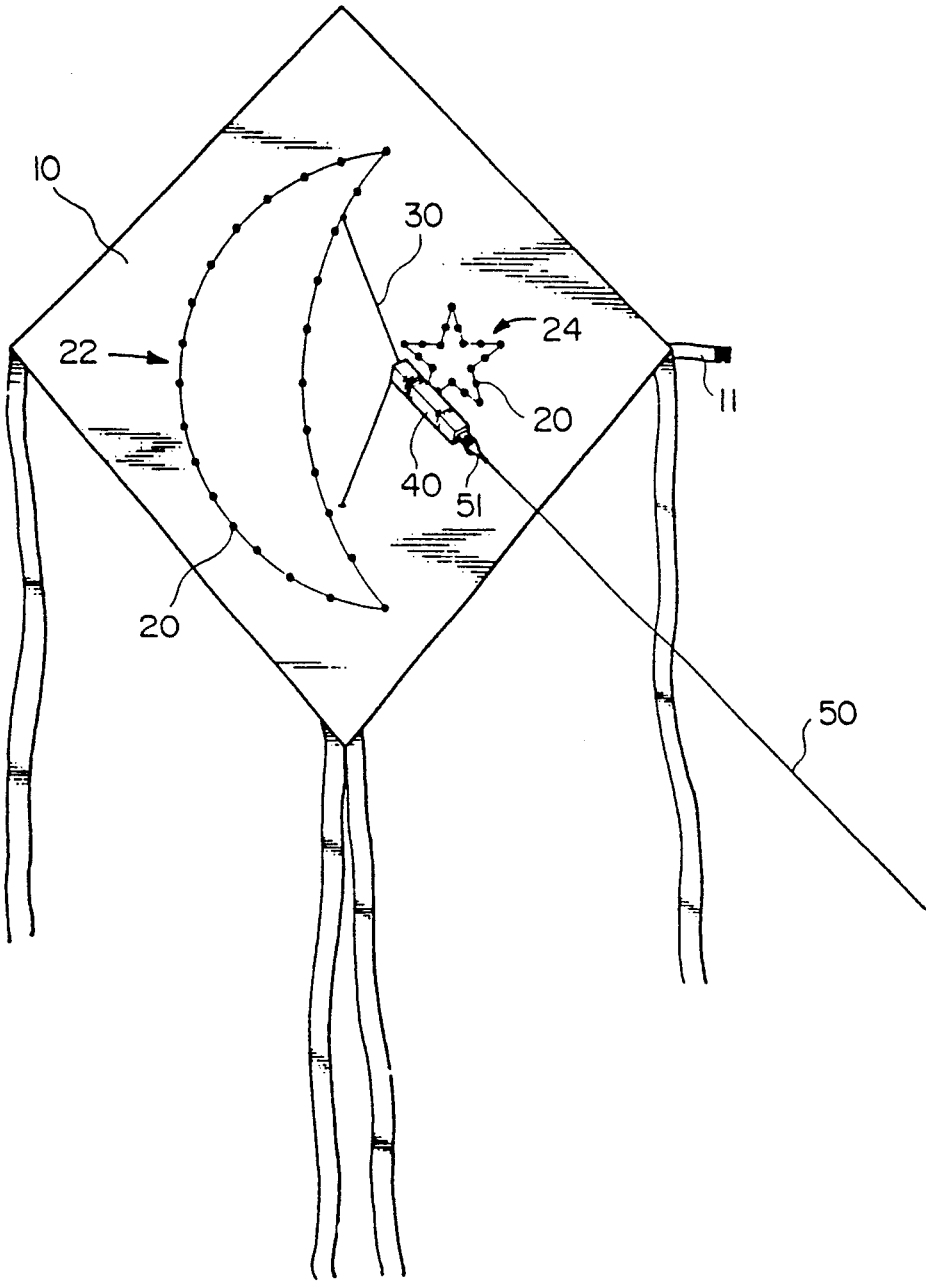
FIG. 1 is a plan view of the kite according to the present invention.

Referring first to FIG. 1, the present invention comprises a kite 10, highly illuminating LED lamps 20, lead lines 30, control box 40 and kite line 50 connected to the control box 40 by hook 51. In addition, a velcro fastening and binding strap 11 is provided for securing the kite 10 when not in use.

As shown in FIG. 1, the highly illuminating LED lamps 20 are arranged in two groups on the front of the kite 10 in the pattern of the moon 22 and a star 24. The LED lamps 20 of each of the patterns are connected to the lead line 30 which is connected to the control box 40.

Figure 2:
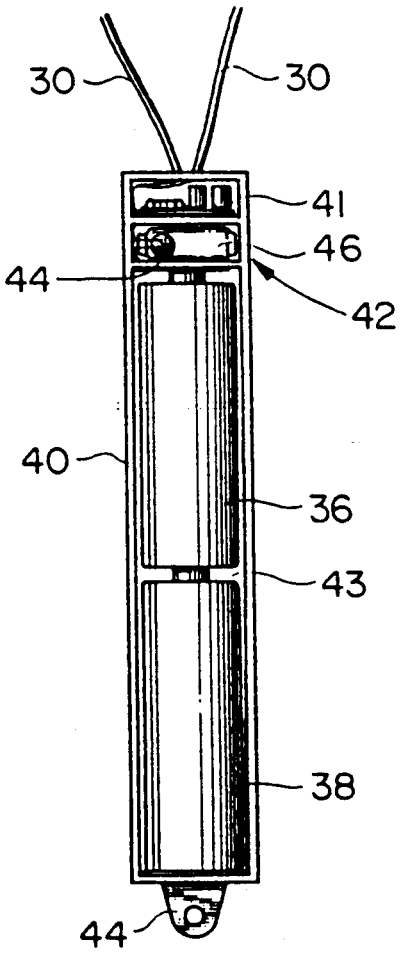
FIG. 2 is a view of the interior of a control box associated with the kite of the present invention.

FIG. 2 illustrates in detail the control box 40. A harmonic oscillating circuit is provided and shown at 41. A mercury switch 42 is also provided and arranged laterally within the control box 40. Batteries 36 and 38 are provided within the battery chamber 43. A fastening bracket 44 is provided at the lower end of the control box 40 for easy connection and disconnection with the hook 51 at the distal end of the kite line 50.

The mercury switch 42 comprises a mercury ball 44 which rolls within the chamber 46 to control the delivery of current from the harmonic oscillating circuit 41 (energized by the batteries 36 and 38) to the LED lamps 20.

Figure 3:
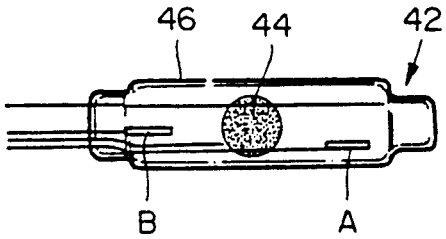
FIG. 3 is a plan view of a mercury switch positioned within the control box of FIG. 2 and used with the kite illustrated in FIG. 1.

Referring to FIG. 3, the mercury switch 42 associated with kite 10 is shown in greater detail. The switch 42 comprises a chamber 46, the mercury ball 44, and switch contacts A and B denoting two switch positions. When the mercury ball 44 rolls to and occupies the position A, the LED lamps 20 associated with the moon 22 will illuminate. When the mercury ball 44 rolls to and occupies position B, the LED lamps 20 of the star 24 will illuminate. Thus, when the kite moves rapidly back and forth in the wind, a shining and glittering effect of the moon 22 and star 24 will be exhibited.

In use the kite 10 can be flown at night and as the attitude of the kite changes due to the wind or air currents, the LED lamps of the moon 22 and the star 24 will be illuminated. Specifically, repeated lateral movement will cause the mercury switch 42 in the control box 40 to sway so that the mercury ball in the switch 42 will roll back and forth and trigger the operation of the oscillating circuit 42 to alternately energize the LED lamps of the moon 22 and star 24.

Figure 4:
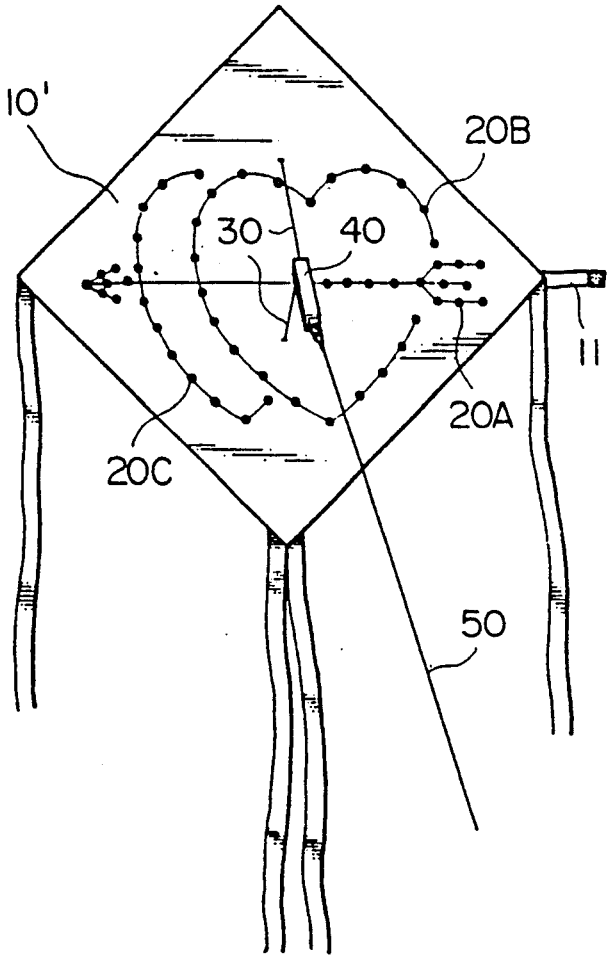
FIG. 4 is a plan view of a kite according to an alternative embodiment of the present invention.
Figure 5:
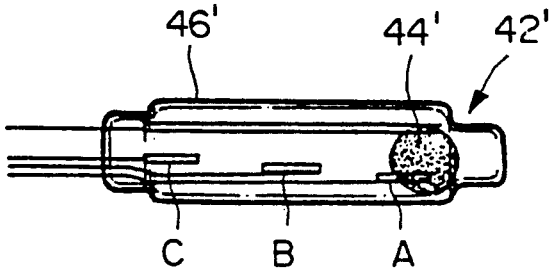
FIG. 5 is a view similar to FIG. 3, illustrating a mercury switch for use with the kite illustrated in FIG. 4.

FIG. 4 illustrates kite 10' according to an alternative embodiment. Kite 10' is similar to kite 10 but has three groups 20A, 20B, and 20C of LED lamps 20. Group 20C is a left side heart shape, group 20B is a right side heart shape, and group 20C is in the shape of an arrow. The mercury switch 42' associated with kite 10' is shown in FIG. 5. The switch 42' includes a chamber 46' that has three switch positions A, B, and C, respectively, for controlling the three groups of highly illuminating LED lamp series 20A, 20B, and 20C. While the kite is flying in the sky, the mercury ball 44' will follow the wavering of the kite and trigger one of the groups of LED lamps 20 depending upon which position the ball is in, similar to switch 42 illustrated in FIG. 3.

FIGS. 6 and 7 illustrate the storage features of the kite according to the present invention. A fastening belt 11 having mating velcro fastening material 12 and 13 is sewn on the side edge of the kite 10 to secure the kite when not in use. The supporting skeleton (not shown) of the kite 10 may be removed and used as an axis about which the kite can be rolled. Then the belt 11 is wrapped around the kite as shown in FIG. 6 and secured via the velcro mating material 12 and 13. This greatly reduces the dimension of the kite 10 so that it can be stored in a bag 50 for transport or storage.

The dimensions of the kite according to the present invention may vary. However, in one example, the area of the kite was approximately 4,200 $cm^2$, and has a loadable weight about 105 grams with the LED lamps weighing 7.5 grams. The total weight of the two battery cells and control box is about 30 grams.

The foregoing description is intended by way of example only and is not intended to limit the present invention in any way except as set forth in the following claims.

I claim:

1. A kite for use at night comprising:

a kite body having a front face and a rear face;

a plurality of electrical lamps disposed on the front face of said kite body, said electrical lamps being arranged into a plurality of discrete groups;

control means including power supply means for energizing said electrical lamps, oscillating circuit means, and switching means, said switching means connected to said power supply means, said oscillating circuit means and said electrical lamps and including a switching member and a plurality of switching positions corresponding to said plurality of discrete groups, said switching member being movable relative to said switching means in response to the movement of said kite body caused by the wind for triggering the energization of a particular group of electrical lamps when in a particular switching position; and lead means for connecting said control means to said kite and providing an electrical connection between said electrical lamps and said control means.

2. The kite of claim 1, wherein said discrete groups of electrical lamps are disposed on said kite body in various geometrical shapes.

3. The kite of claim 1, and further comprising a fastening means attached to said kite body and including male and female fastening material so that said kite body can be rolled up and secured for storage.

4. The kite of claim and further comprising a control casing for containing said control means, said control casing being elongated in shape and wherein said switching means comprises a mercury switch having a chamber for containing a mercury ball defining said switching member, said mercury switch being installed laterally in said control casing so that lateral movement of said kite causes said mercury ball to move to the switching positions for triggering the energization of said electrical lamps.

5. The kite of claim 1, wherein said electrical lamps are LED lamps.

6. The kite of claim 1, and further comprising:

kite line means for handling by a user to control the flight of said kite; and a hook member for removably connecting said kite line to said control means.

* * * * *